United States Patent [19]

Kumbera et al.

[11] 4,168,414

[45] Sep. 18, 1979

[54] PROTECTIVE SWITCH DEVICE AND OPERATING MECHANISM THEREFOR

[75] Inventors: David G. Kumbera, Greendale; John A. Bordak, Milwaukee, both of Wis.

[73] Assignee: McGraw-Edison Company, Milwaukee, Wis.

[21] Appl. No.: 898,105

[22] Filed: Apr. 20, 1978

Related U.S. Application Data

[62] Division of Ser. No. 555,948, Mar. 6, 1975, Pat. No. 4,124,790.

[51] Int. Cl.[2] ..... H01H 21/00

[52] U.S. Cl. ..... 200/153 G; 200/153 SC; 200/67 PK; 200/318

[58] Field of Search ..... 200/153 R, 153 SC, 153 G, 200/153 H, 318, 67 PK; 335/166, 167, 168, 169

[56] References Cited

U.S. PATENT DOCUMENTS

| | | | |
|---|---|---|---|
| 2,578,349 | 12/1951 | Goodwin | 200/318 |
| 2,932,706 | 4/1960 | Bodenschatz | 200/153 G |
| 2,937,258 | 5/1960 | Starr | 200/318 |
| 3,134,879 | 5/1964 | Gunthier et al. | 200/318 |
| 3,562,454 | 2/1971 | Chance | 200/153 G |

*Primary Examiner*—Richard E. Aegerter
*Assistant Examiner*—John W. Shepperd
*Attorney, Agent, or Firm*—Andrus, Sceales, Starke & Sawall

[57] ABSTRACT

A vacuum contact enclosure has end contact assemblies within contact enclosures specially formed to distribute the high voltage field and eliminate high stress in an encapsulating solid insulation. A non-tracking guide tube extends concentrically of a movable contact rod. A solid, dry, high voltage insulation wall intimately attaches to the vacuum and contact enclosures. The wall has an opening through which the contact rod extends with a planar end wall surface abutting a submersible operating housing. A clamp engages the wall and housing and draws the wall surface into sealing engagement with the housing. The operating mechanism includes a pivoted lever assembly connected to a spring-loaded linkage member secured to the contact operating member and a spaced drive lever and pin assembly. A toggle assembly is pinned between the assemblies and includes a releasable latch member. An extension spring is connected at opposite ends to the lever assemblies to rapidly open the contacts upon release of the latch member. A separate closing spring is connected to the lever and pin assembly. A trip-free operating handle has a reset arm engaging a pivoted arm for pivoting the lever and pin assembly to reestablish the toggle latch and simultaneously stress the both extension springs. The reset arm disengages and releases the mechanism and the closing spring pivots the reset toggle mechanism to close the contacts.

17 Claims, 12 Drawing Figures

PROTECTIVE SWITCH DEVICE AND OPERATING MECHANISM THEREFOR

This is a division of application Ser. No. 555,948, filed Mar. 6, 1975, now U.S. Pat. No. 4,124,790.

BACKGROUND OF THE INVENTION

This invention relates to a protective switch device for power distribution systems and particularly to a vacuum fault interrupter and switch assembly including a positive contact operating mechanism connected to the movable contact of an interrupter.

In residential power distribution systems and the like interrupters or switching apparatus are incorporated into the system to provide automatic protection in response to abnormal load or line conditions and permit manual opening and closing of the circuit. The interrupters may advantageously seal the contacts in a vacuum enclosure with a movable contact having an operating member extending through a vacuum seal in the enclosure.

A vacuum interrupter unit has been widely employed in the prior art because it provides fast, low energy arc interruption with long contact life, low mechanical stress and a high degree of operating safety. Generally, the creation of the arc within a vacuum significantly extends the life of the contact and the interrupter when compared with oil filled interrupters. Vacuum interrupters further are not as affected by temperature and/or altitude. A spring loaded toggle mechanism is preferably coupled to the operating member for rapidly and positively opening and closing of the contacts. The toggle mechanism should minimize arcing while maintaining reliable contact engagement under normal service conditions. A manual control member or lever normally provides for resetting of the tripped mechanism as well as manual closure of the contacts and opening when necessary. The manual operating lever should be loaded to require positive positioning of a control lever and thereby prevent accidental actuation which should also be readily operated from a remote location. For example, if the switchgear is located within a below ground vault, the operating lever should be operable with a hook member from above the ground. With the recent development of underground distribution systems demand has risen for switchgear which can be mounted below as well as above the ground. For below ground installation, the switch gear must be designed to meet rigid specification which includes operation while submerged in ground contaminated water and the like. For example, the toggle mechanism and interrupter may be encased or encapsulated within an insulating material to totally encase the assembly.

The interrupter assembly should further be of a relatively rugged construction for use in various applications, while permitting convenient manipulation for installation, removal and maintenance. The interrupter unit in various different applications requires different toggle mechanisms. The interrupter unit is, in most installations, a vacuum enclosed type wherein the contacts are located within a vacuum bottle enclosure. The operating mechanism specification may differ with the installation. The interrupter unit and operating mechanism are, therefore, preferably separate devices with appropriate convenient connection.

Although various interrupters with spring loaded linkages have been suggested, there is a continuing need for an improvement in the construction of the actuating mechanism and the interrupter contact structure as such.

SUMMARY OF THE PRESENT INVENTION

The present invention is particularly directed to an improved high voltage vacuum interrupter assembly and more particularly a one-shot to lock-out underground vacuum interrupter which can be mounted in a vault below ground level. Generally, in accordance, with one feature of the present invention, the vacuum interrupter includes a separate, encapsulated vacuum chamber encased within a solid thick wall insulating material in intimate contact with the vacuum chamber to form a self-supporting unit within which the fixed contact and a movable contact are disposed. The movable contact includes an operating member projecting outwardly of the encapsulating insulating material and a pair of circuit contact connectors are cast into the material to maintain an integral outer wall member with the single opening from which the movable contact extends in a sealed manner. A tripable toggle mechanism may be coupled to the member for automatic and/or manual, rapidly moving of the movable contact.

In accordance with a further aspect of the present invention, the toggle mechanism is enclosed in a suitable housing which for applications requiring possible submersion is a separate submersible enclosure or housing.

The interrupter unit is formed with an end face adapted to be sealed abutting an operating mechanism, submersible cabinet in fluid tight relation with the operating rod projecting into the submersible cabinet. The enclosure or housing preferably also houses a suitable electronic circuit for actuatof a low energy flux tripper or the like for activating of the operating mechanism.

The solid insulation is provided in sufficient quantity to provide a strong, self-supporting interrupter construction with integral contact bushings cast about the appropriately located connectors. The solid insulation may be relatively thin when compared to air or oil insulating medium where a plurality of the interrupter must be mounted adjacent each other. The solid insulation permits much closer assembly and a more compact assembly. The interrupter unit is thus physically mounted on the housing with the operating member extended through a sealed coupling opening and connected to the mechanism. An electro-responsive trip means provides for automatic tripping of the toggle mechanism. An external operating handle for manual manipulation and positioning of the contact operating member is also provided. The combination of the encapsulated vacuum interrupter and the enclosure provide an efficient, reliable interrupter which can be readily serviced and maintained. Further, the encapsulated vacuum fault interrupter sub-assembly can be incorporated into and adapted to different operating mechanisms as required.

In accordance with a unique aspect and feature of the vacuum fault interrupter, the interrupter unit is formed with an elongated vacuum damber sub-assembly which is then mounted within a mold with suitable end contact enclosures and interconnected connectors. The end contact enclosures are specially formed to distribute or grade the high voltages in the connection and essentially eliminate high stress of the insulation. An operating guide member of suitable insulating material is secured to the adjacent enclosure for the movable contact and extends concentrically of the operating member.

The member functions to prevent high voltage tracking along the necessary tubular opening for the operating member. A conductive layer extends along the guide tube from the end contact assembly to distribute the field and prevent high stress on the insulation. The sub-assembly is coated with a suitable, resilient layer, except for the guide member, after which the total assembly is encapsulated in a suitable, moisture resistant and solid insulating material to provide a solid, dry, high voltage insulation wall intimately attached to the vacuum sub-assembly.

In accordance with a further significant and important feature of the present invention, the operating mechanism includes a novel toggle mechanism including separate, yieldable means for the quick closing and for the quick opening of the movable contact. Generally, the mechanism includes a manually operated input lever which, in moving to the closed position, serves to stress both of the yieldable means for operating the toggle mechanism. The lever is coupled to the mechanism as a trip-free lever with the tripped toggle mechanism collapsing without moving of the operating lever, which must, however, be actuated to again reset the toggle mechanisms.

More particularly, the mechanism in on important feature and construction includes a unique toggle mechanism responsive to the energy stored in a pair of extension springs, one of which is effective during opening of the contacts and the other of which is effective during the closing of the contacts. The toggle mechanism includes a trip lever which is set by closing contact movement of the manual operating handle and preferably requires movement from the closed position to the complete open position and reset to the closed position. In the set position, the toggle mechanism can be released to open the contacts by movement of the operating lever to the open position or in response to an electromagnetic activation of the trip lever. In manual closing of the contacts, the yieldable means is stressed and then released with the linkage and toggle mechanism to produce a positive closure.

In particular, the toggle mechanism includes a pivoted lever assembly connected to a spring-loaded linkage member secured to the contact operating member. A drive lever and pin assembly is pivotally mounted in spaced, aligned relation to the lever arm assembly and connected thereto by the opening extension spring which is stressed in the closed contact position to urge the two assemblies toward each other. A toggle assembly is secured or pinned to the lever arm assembly and to the lever and pin assembly and includes a latch member which, when actuated, releases the toggle assembly and the tension in the opening extension spring to rapidly collapse the toggle mechanism and pivoting of the lever arm assembly and the arm assembly to move the linkage, thereby effecting a rapid opening movement of the latch member which is actuated from a pivoted trip lever.

The operating handle is rotatably mounted for accurate movement between the contact open and contact closed position. A trip arm is secured to the handle and moves to trip the latch lever. A contact opening and reset arm is also secured to the handle and engages the drive lever and pin assembly to reset the collapsed toggle assembly. The drive lever assembly includes a pivoted stop arm which is engaged by the reset arm to move the assembly to the extended position and simultaneously stress the closing extension spring member. Just prior to movement to the closed position, a latch means moves to prevent return of the drive lever and pin assembly to the collapsed position and the handle reset arm disengages from the pivotal stop arm. Slight continued movement of the handle to the closing position releases the latch means and thus releases the closing spring and toggle mechanism to rapidly reset the mechanism and move the contacts to the closed position.

The combination of the high speed reliable mechanical mechanism enclosed within a submersible housing, in combination with the encapsulated vacuum fault interrupter secured thereto, has been found to provide a highly reliable, lightweight fault interrupter which can be conveniently installed and operated. The encapsulated interrupter minimizes the necessity of maintenance and contributes to long life. The separate submersible housing permits the adaptation of a single encapsulated fault interrupter to widely different construction and while maintaining the desired versatility in above and underground mounting.

BRIEF DESCRIPTION OF DRAWINGS

The drawings furnished herewith illustrate the best mode presently contemplated by the inventors and clearly disclose the above advantages and features, as well as others, which will be readily understood from the detailed description thereof.

In the drawings.

DESCRIPTION OF ILLUSTRATED EMBODIMENT

Figure 2:
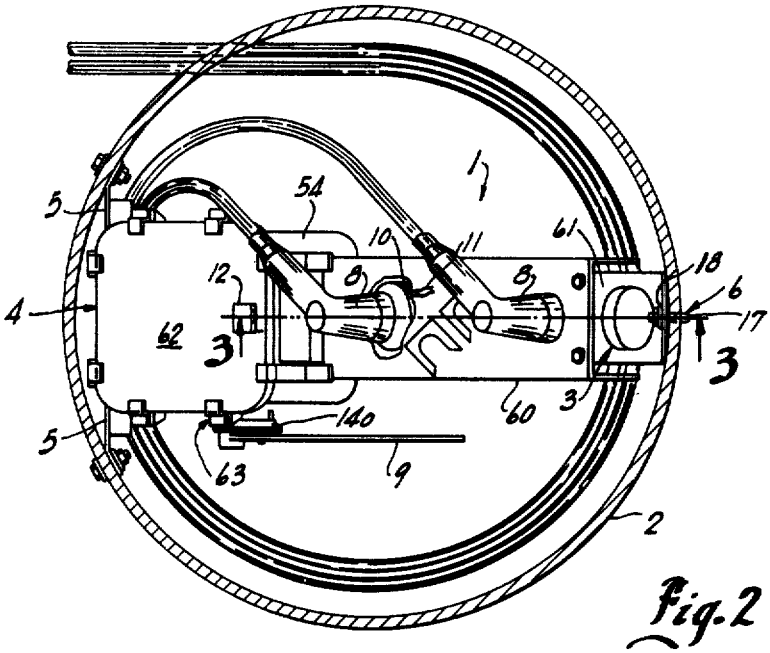
FIG. 2 is a top view taken generally on line 2—2 of FIG. 1.
Figure 1:
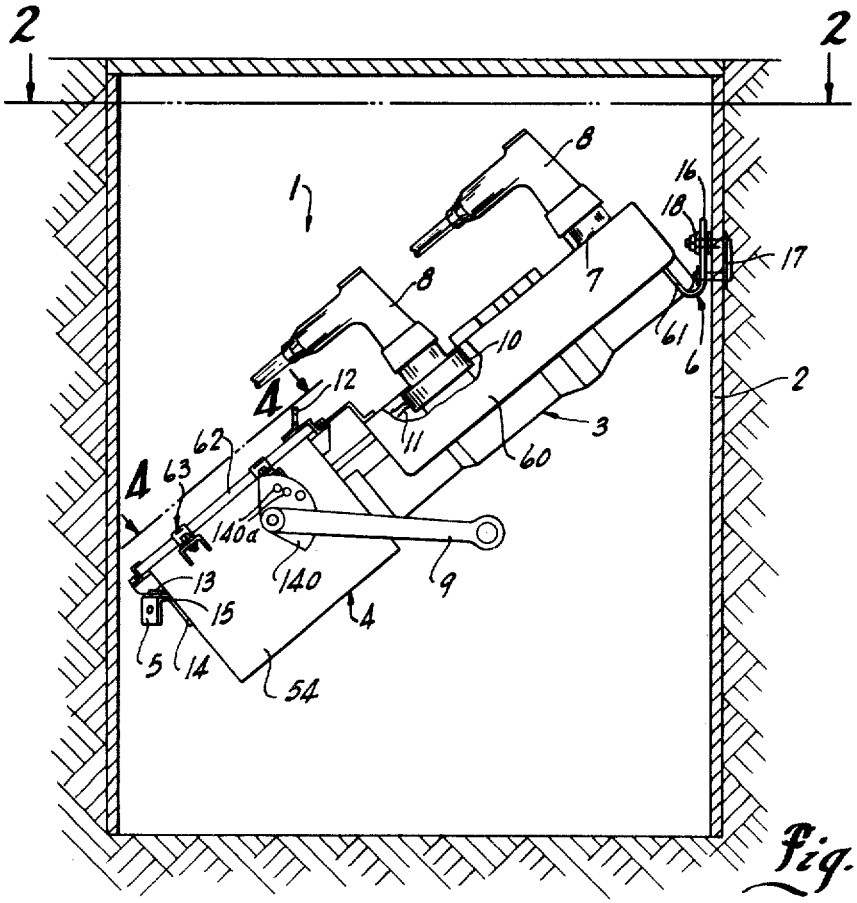
FIG. 1 is a generally vertical section through a below ground power distribution vault, with an interrupter switch device constructed in accordance with the teaching of the present invention mounted therein.

Referring to the drawings and particularly to FIGS. 1 and 2, a submersible protective switch device 1, constructed in accordance with the teaching of the present invention, is mounted within a below ground vault 2. The device 1 is of a generally elongated construction having an interrupter unit 3 attached at one end to an operating unit 4. Device 1 is mounted at an angle, such as forty-five degrees, with the operating unit 4 at the lower end resting on a mounting bracket 5 and the interrupter unit 3 at the upper end secured in place by a single releasable clamp unit 6. The interrupter unit 3 includes a pair of spaced contact bushings 7 for securing to power line connectors 8 and operable to open and close the circuit.

The operating unit 4 includes a manual operating handle 9 extending from unit 4 for manual opening and closing of the interrupter unit 3. The upper end of the handle 9 is apertured, as shown in FIG. 1, to provide for remote operation from above the vault 2 by a suitable hook member. A current pick-up 10 is secured to one of the bushings 7 to provide a signal responsive to fault line conditions. The pick-up signal lines 11 connect the output of pick-up 10 to the operating unit 4 for automatic tripping to open the interrupter unit 3. The protective switch device 1 is also provided with a central lifting lug 12 for remote removal of the device. The mounting bracket 5 is provided with a pair of upstanding headed pins 13. An attachment bracket 14 on unit 4 includes a pair of corresondingly spaced edge slots 15 adapted to telescope with the pins 13 resting on the bracket 5 to releasably support the lower end of the device 1. The upper end of the interrupter unit 3 is provided with a mounting bracket 16 having a pair of vertically spaced openings telescoped over a correspondingly shaped support U-bolt 17 the upper one of which is threaded to accept a locking nut 18.

The switch device 1 can be readily removed or installed from above ground by the crewmen without entering of the vault 2 by merely loosening the upper unit 18. The relatively lightweight assembly can be readily picked up by the workmen through a hook stick coupled to a lifting lug 12.

Generally, one aspect of the present invention is directed to the construction of the interrupter unit 3 as an elongated, encapsulated vacuum unit which is adapted to be connected to and extending from a suitable operating mechanism and is further directed to a novel contact operating toggle mechanism for fault interrupters. As applied to an underground fault interrupter, switch device, the present invention provides an encapsulated vacuum fault interrupter which is sealed to a totally submersible, separate, operating mechanism 4.

The interrupter unit 3 is sealed to the housing of the unit 4 to create a waterproof switch device 1.

Figures 3, 3A:
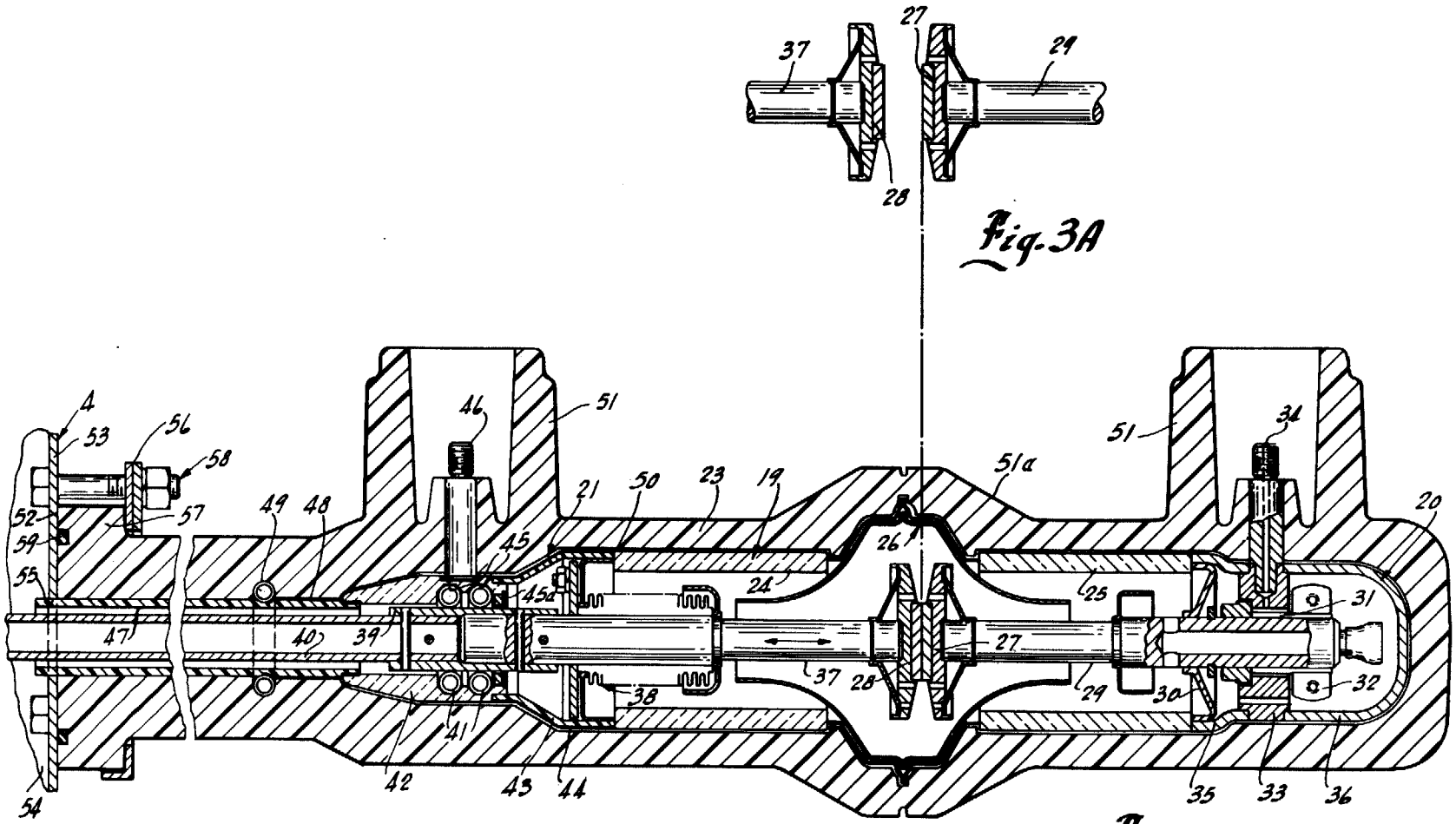
FIG. 3 is an enlarged vertical section taken generally on line 3—3 of FIG. 2 and illustrating a novel embodiment of an encapsulated fault interrupter unit shown in FIGS. 1 and 2 as a part of the switch device and constructed in accordance with one aspect of this invention.
FIG. 3A is a view of the contacts in the open position.

More particularly, as shown in FIG. 3, the illustrated interrupter unit 3 includes a vacuum enclosure 19 with contact end connector cap units 20 and 21 cast and specially encapsulated within an outer solid insulation housing or wall 23 to form an integrated self-supporting structure. The vacuum enclosure 19, in accordance with usual practice, includes a pair of tubular insulators 24 and 25 with a centrally located contact shield assembly 26 mounted therebetween. A pair of power interrupt contacts 27 and 28 are located centrally of the assembly 26. Contact 27 is a fixed contact having a contact rod 29 extending coaxially and being mounted in an end bell 30.

The fixed contact rod 29 is connected to a current exchange assembly including a split tubular current exchange connector 31 clamped to rod 29 as by a clamp 32. An annular contact disc 33 is brazed to connector 31 with a contact terminal or threaded stud 34 braced thereto and projecting outwardly therefrom to receive a line contact or connector. The annular disc 33 has recessed outer end edges to receive a spacer 35 which telescopes over the end bell 30 into abutting attachment to the tubular insulator 25. A cup-shaped end cap 36 abuts the opposite end of dics 33 and thus encloses the contact assembly. Fixed spacer 35 and end cap 36 are formed of a suitable conductive material and defines a total enclosure of the high voltage exchange assembly. Spacer 35 and cap 36 are formed without sharp or pointed edges or areas and serve to distribute the high voltage as the fixed contact assembly. The enclosure of the assembly thus eliminates high stress of the encapsulating wall 23 at the fixed contact end.

Contact 28 is a movable contact and includes a contact rod or shaft 37 extending coaxially through a suitable vacuum seal 38 in the opposite end of the enclosure 19. The shaft 37 is coupled to the operating mechanism of unit 4, as more fully described subsequently, and provides for the selective opening and closing of the contracts 27–28 within the vacuum enclosure 19.

A current transfer assembly for the movable contact 28 includes a tubular contact 39 telescoped over the operating shaft 37 and pinned thereto. The tubular contact 39 extends coaxially therefrom and is pinned to a coupling operating tube or shaft 40, which projects coaxially outwardly into the operating unit 4, for automatic or manual positioning of the contact 28 as more fully developed hereinafter.

The contact 28 is connected in circuit through a pair of contact coil springs 41 secured within a conductive contact housing 42 in encircling, sliding contact with member 39. The contact housing 42 is connected to a generally funnel-shaped end cap or spacer 43 which is formed of a suitable insulating material such as bakelite, suitable plastic or the like. Spacer 43 slides over the vacuum enclosure end seal 38 into abutting attachment to the insulator to maintain a smooth continuous outer surface and a correspondingly notched end of the contact housing 42 to provide a similar smooth continuous surface. The contact housing 42 has a substantially smaller diameter than the vacuum enclosure 19 and the spacer 43 has a central offset portion with axially spaced cylindrical portions providing for the corresponding coupling to the vacuum enclosure 19 and to the spring contact housing 42.

The outer surface of spacer 43 is provided a high resistive paint 44 which extends from the contact 42 to the end seal 38. The insulating spacer contains the high voltage field and provides a smooth continuous surface to prevent high stress points. The conductive paint layer 44 prevents damaging bulk current flow through the spacer 43 to seal 38. The latte is a known device including a thin metal bellows members, which would be readily punctured if such current of any significant level existed.

The housing 42 has an internal diameter somewhat slightly larger than the operating shaft and contact 39 and includes closely spaced, annular recesses 45 on the interior within which individual spring contacts 41 are located. The recesses are of a slightly smaller diameter than the spring contacts 41 which project outwardly into supporting engagement with the tubular contact 39. The inner end of the housing is enlarged to allow entry of the springs 41 into the recesses and closed with a suitable washer-retaining ring assembly 45*a*. The contact housing outer wall is chamfered downwardly with a smooth curved and thus non-stressing forming surface to a reduced outer diameter section. A threaded connector stud 46 is attached to conductive housing 42 and projects outwardly for connecting in circuit.

A guide tube 47 of an insulating material is secured in telescoped relation to the outer end of the contact housing 42 and projects outwardly concentrically of the operating rod 40 and the encapsulating, insulating shell or housing 23.

The tube 47 is formed of non-tracking material such as an acrylic or other suitable material to prevent the creation of tracking current within the passageway for the operating shaft 40.

A conductive paint or layer 48 is intimately applied to the inner end of the tube 47 including the joint between the tube and contact housing 42 to form a firm electrical bond. The layer 48 extends outwardly of housing 42 to a smooth annular conductor 49 shown as a conductive spring similar to spring 44 encircling the guide tube 48 and embedded within the encapsulated housing or wall 23.

The tube 47 is slightly recessed to receive the conductor 49 and the conductive layer 48 extends partly into the recess, shown as approximately half way, beneath and in intimate contact with the spring. The extension thus again avoids all sharp edges in the end shield assembly for maintaining optimum voltage gradients and thereby avoids damaging of the insulation wall.

The outer surface of the vacuum enclosure 19 and the extended, fixed contact housing assembly elements 33, 35 and 36 and the front contact assembly elements 42 and 43 are coated with a suitable layer 50 of a resilient or flexible material 50 such as rubber. The guide tube 47, and studs 34 and 46 are not covered with the resilient coating 50. The coated assembly is mounted within a suitable form and the outer encapsulating housing 23 is cast in place with a pair of outwardly projecting terminal receiving bushings 51 integrally formed about the uncoated studs 34 and 46. The well bushings 51 are molded as an integral part of the solid insulation and are preferably constructed to interphase with all industry-standard bushing plug inserts. The exterior of the encapsulating wall 23 is coated with a suitable conductive paint or the like as shown at 51*a*.

The process of molding may be in accordance with any known procedure which will produce a physically strong electrical insulating outer shell. Generally, a particular and highly satisfactory method is disclosed in the copending application of David G. Kumbera, one of the present joint inventors, entitled "ENCAPSULATED VACUUM FUSE ASSEMBLY", which was filed on Jan. 8, 1975, with Ser. No. 439,419, and is assigned to the same assignee as this application. In the illustrated embodiment of the present invention, the end contact assemblies 20 and 21 are also coated with the inner rubber-like layer. The guide tube 47 as well as the contacts studs 34 and 46 are not. The insulation wall may, as more fully disclosed in the aforementioned application, be of any suitable epoxy or other solid insulating material and may be reinforced with appropriate additives of glass, any natural mica or any other suitable material. Generally, a basic Bisphenol-A epoxy with an added inert filler including silica and Wolanstonite to improve mechanical and electrical properties has been employed to produce a commercial interrupter.

The inner or forward end of the wall 23 of the encapsulated interrupter 3 in the illustrated embodiment is formed as a planar surface 52 adapted to be secured or clamped into abutting engagement with the adjacent flat sidewall 53 of the submersible housing 54 of the operating unit 4, with the attachment made directly through means fixed to the wall 23.

The housing 54 includes an opening 55 through which the interrupter guide tube 47 and operating shaft 40 extend, with the operating shaft 40 coupled to the operating, mechanism as more fully developed hereinafter.

As encircling multiple part collar member 56 abuts an integrally formed clamping enlargement and ledge 57 on the encapsulated wall 23. Stud and nut members 58 on the housing pass through appropriate openings on the collar and clamping nuts are drawn up tightly to firmly attach the encapsulated interrupter to the housing through the structure of the high strength insulating wall 23. An annular O-ring seal 59 is located between the housing and the abutting sealing surface of the encapsulated interrupter to define a liquid-tight joint.

The encapsulated interrupter 3 provides a strong, self-supporting, integrated element which can be directly mounted as a part of a total assembly and a particularly practical construction for an underground fault interrupter as shown in FIGS. 1–3 of the drawings and described above. In the illustrated embodiment, the encapsulated interrupter 3 is mounted beneath a generally U-shaped bale and parking member 60, the inner end of which is secured to the submersible housing. The outer end of the interrupter 3 is supported on vault 2 by the member 60 which has a back wall 61 connected as a part of the support bracket 6. The member adjacent the back wall 61 is supported by passing of the self-supporting interrupter through an opening in the back wall. The top wall of member 60 is provided with appropriate openings for the bushings 51 and may be provided with other appropriate tabs and the like.

Referring particularly to FIGS. 1 and 2, the illustrated submersible housing 54 is generally a rectangular, box-like structure having a top mounted cover 62 which is releasably secured by a plurality bolt latch 63 for providing a liquid-tight enclosure for the operating mechanism housed therein.

In accordance with a further novel aspect and feature of the invention, a unique operating mechanism employing separate stored energy in yieldable members is employed for both closing and opening movement of the contact 28, whenever the contact is moved either by manual positioning of the operating handle 9 or automatically tripped in response to the signal from the pick-up 10. A preferred embodiment of a toggle operating mechanism is shown in FIGS. 4–11.

The operating mechanism is generally attached to a pair of laterally spaced and parallel frame plates 64 and 65 which are interconnected to each other by a plurality of interconnecting bolt members 66 having suitable spacers thereon to locate the operating mechanism between the plates and to form a rigid interconnected sub-assembly. The one frame plate 64 includes slot means for rigidly attaching the sub-assembly within the housing 54 as by a pair of mounting bolts 67.

A heavy strengthening and latch bracket 68, which is a downwardly opening, U-shaped channel, is secured generally centrally between the frame plates 64 and 65 and mounted on the front and aft mounting bolt members 66 with lateral spacers to the opposite sides.

Figure 4:
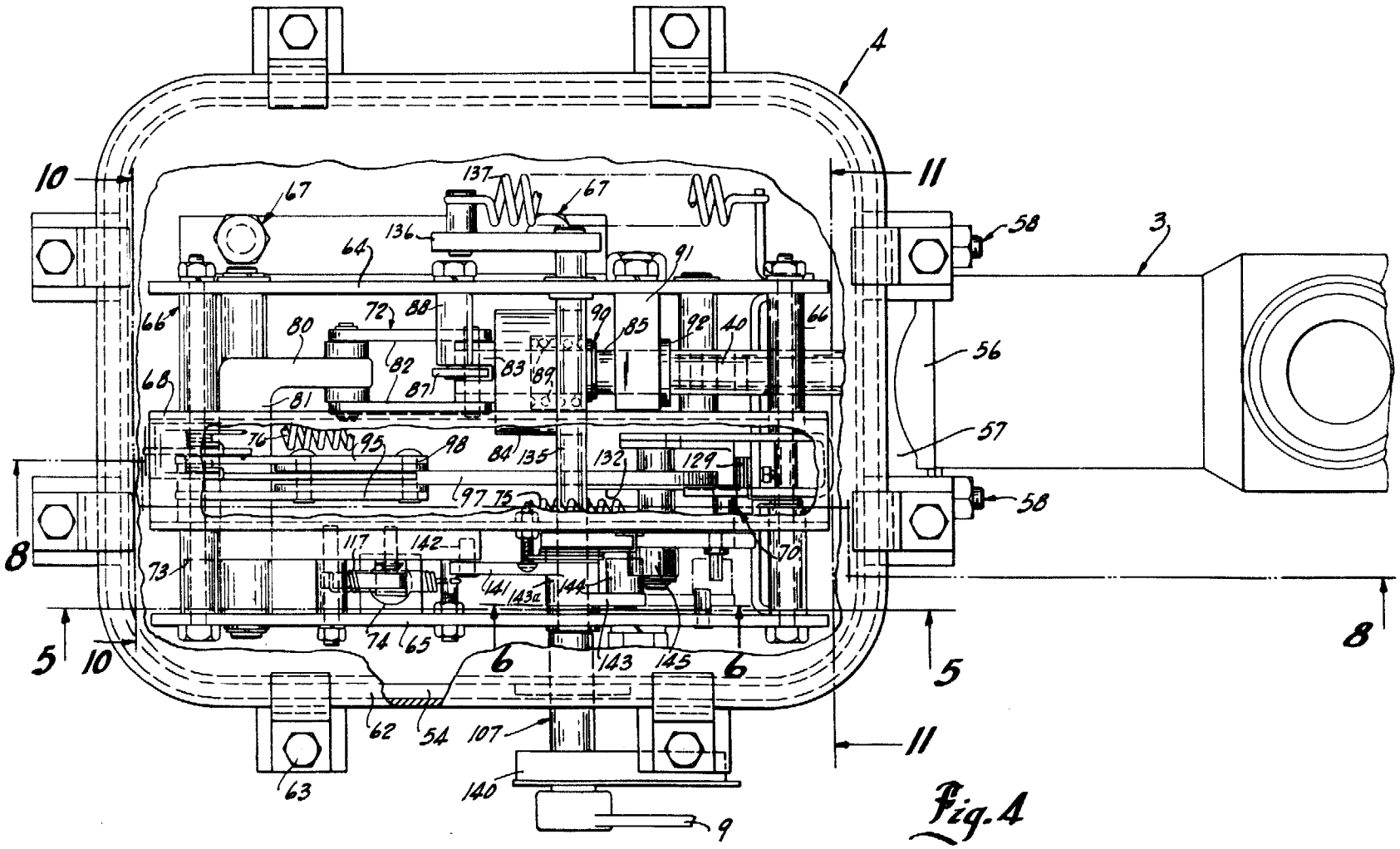
FIG. 4 is an enlarged top plan view of the switch device taken generally on line 4—4 of FIG. 2, with parts broken away and sectioned to show details of construction of one embodiment of a toggle operating mechanism, in accordance with the teaching of the present invention.
Figure 5:
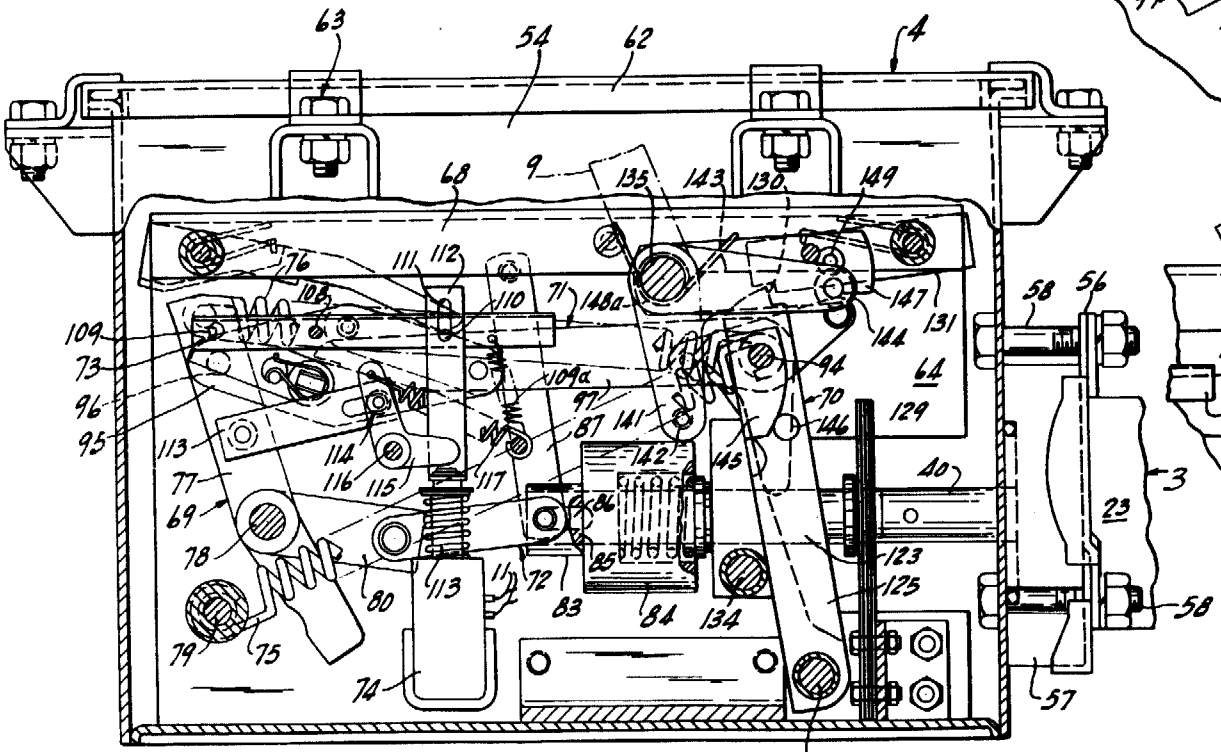
FIG. 5 is a side elevational view of FIG. 4 taken generally on line 5—5 with parts broken away and sectioned to more clearly illustrate the toggle linkage in a closed contact position.
Figure 8:
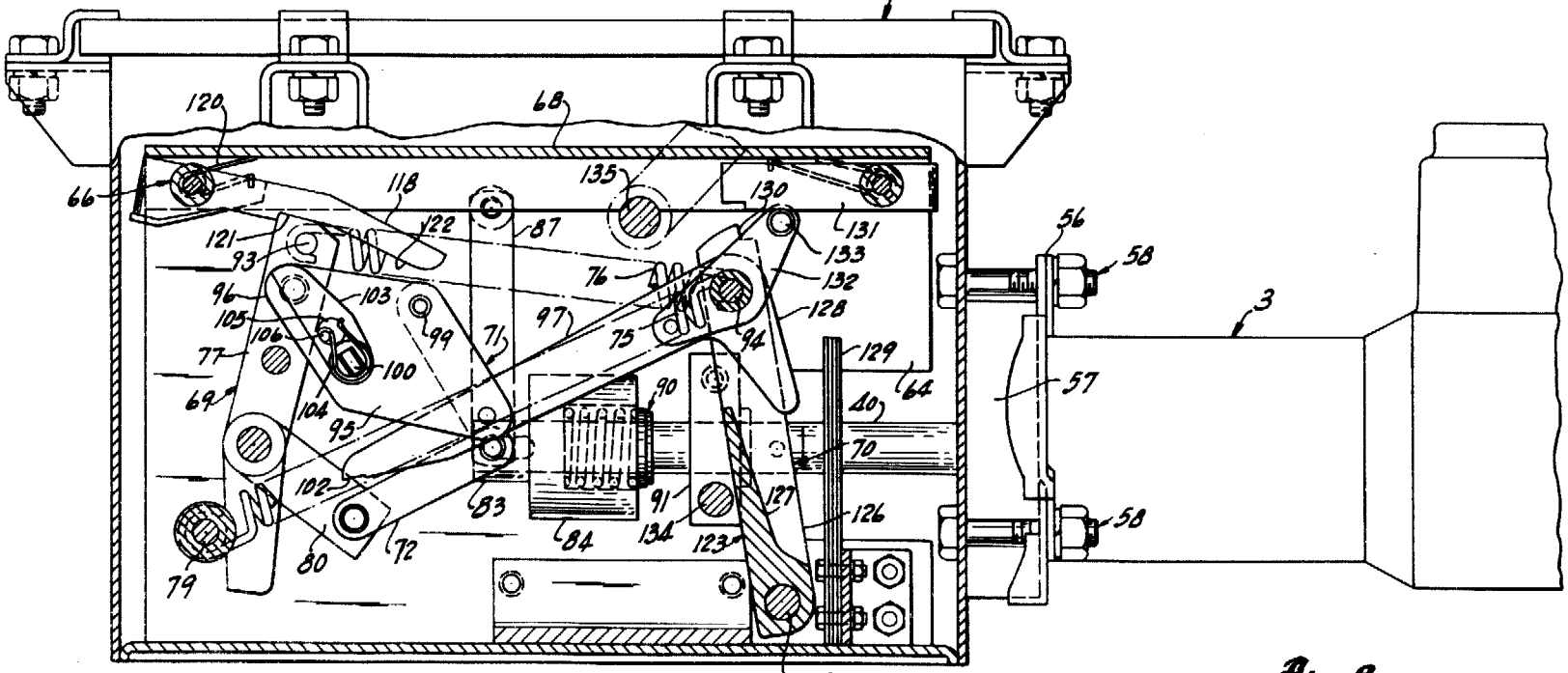
FIG. 8 is a view taken on line 8—8 of FIG. 4 with the toggle mechanism illustrated in the alternate collapsed position.
Figure 11:
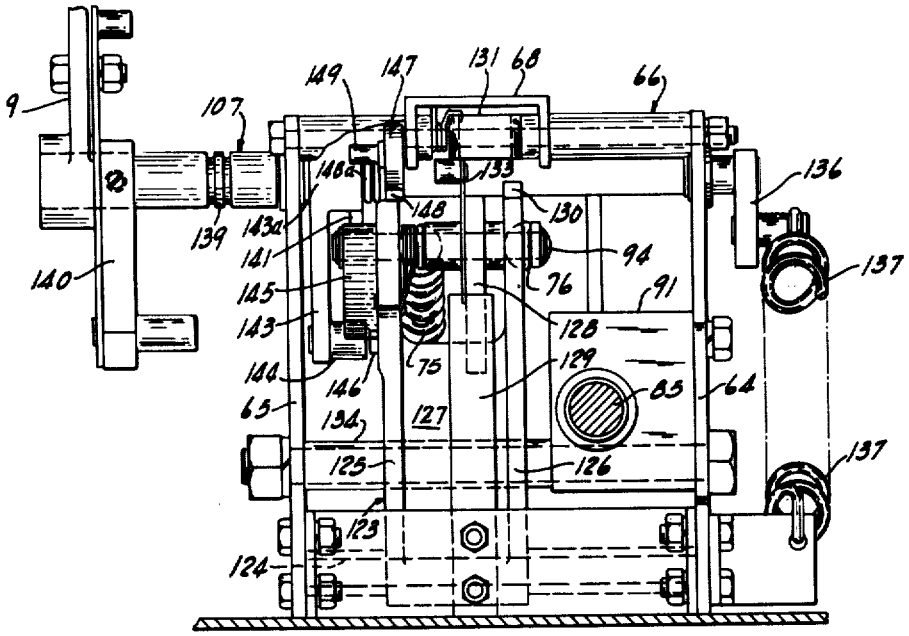
FIG. 11 is an end view taken generally on line 11—11 of FIG. 4.
Figure 10:
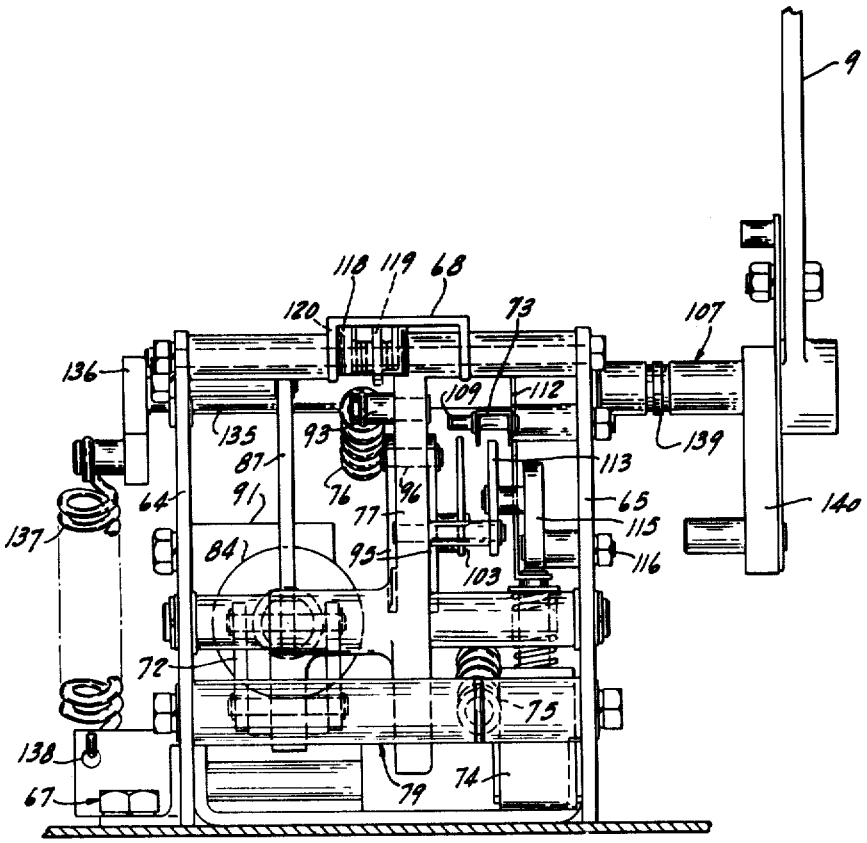
FIG. 10 is an end view taken generally on line 10—10 of FIG. 4.

As more clearly shown in FIGS. 4 and 5, the toggle operating mechanism generally includes a lever assembly 69 pivotally mounted to one end thereof. A drive arm and pin assembly 70 is pivotally mounted in spaced aligned relation to the lever assembly 69 with parallel axis of rotation. A toggle lever assembly 71 is pivotally secured to the lever assembly 69 and drive arm assembly 70. The toggle lever assembly 71 is releasably latched in an extended or expanded position, as shown in FIG. 5, holding the lever and drive arm assemblies 69 and 70 pivoted to a fully extended position. A linkage 72 couples the lever assembly 69 to the movable contact shaft 40 of interrupter 3 and in the expanded toggle position firmly holds contact 28 in engagement with contact 27. The toggle lever assembly 71 includes a trip lever 73 which may be actuated by either manual pivoting of the operating handle 9 or energizing of a suitable electrical operator 74 such as a low energy flux tripper. When tripped, the toggle mechanism 71 collapses between the lever assembly 69 and drive arm assembly 70. The lever assembly 69 pivots toward assembly 70 which is held against a stop by the spring forces, as shown in FIGS. 5 and 8. The lever assembly 69 actuates the linkage 72 to rapidly move the contact 28 to the open position.

The operating mechanism further includes a contact closing spring 75 and a separate contact opening spring 76, both of which are loaded or stressed in moving the contacts to the closed position, as more fully developed hereinafter, to provide a positive spring-driven movement of the interrupter moveble contact 28 on closing and opening.

The lever-toggle mechanism produces a highly satisfactory operating mechanism wherein the desired spring forces can be generated while maintaining a compact construction. Thus, the spring will readily produce forces on the order of ninety pounds.

More particularly, the lever assembly 69 includes a lever arm 77 rotatably mounted on a shaft 78 secured to the lower aft portions of the side frame plates. Suitable spacers located to the opposite sides of the lower arm 77 locate the lever arm generally below the latch bracket 68. The lower end of the lever arm 77 projects downwardly and forwardly beneath the shaft 78 and in front of a stop shaft 79 which limits the collapsing pivotal movement, as shown in FIG. 8. A coupling link 80 is cast with an integral hub portion 81 to the lever arm 77 and is spaced axially thereof to one side of the toggle mechanism. The coupling link 80 projects forwardly from the arm and the outer end is pivotally pinned to the coupling linkage assembly 72 and particularly between a pair of similar coupling links 82. The coupling links 82 project forwardly and are pivotally pinned to an attachment boss 83 on the backside of an impact sleeve 84. An operating contact rod extension 85 is slidably mounted in the sleeve 84 with the outer end attached to the shaft 40 of the encapsulated interrupter 3. The extension 85 projects into the boss 83 and is secured to the pin by an elongated slot 86. A supporting pivot link 87 is mounted on the pivot arm and projects upwardly therefrom with the upper end pivotally secured to the side frame 64 by an appropriate shaft-spacer unit 88 to support the assembly for limited axial movement. The contact rod extension 85 extends through the impact sleeve 84. An impact coil spring 89 encircles the extension 85 and is held therein by a retaining ring 90 secured to the rod extension. Compression of the spring 89 in response to relative limited movement of the impact sleeve 84 relative to the extension 83 as permitted by the slotted connection to the connecting pin, spring loads the contact 28 in the closed position.

The extension rod 83 is also guided in a suitable support 91 secured to the side frame 64 with a suitable lubricant provided therein to guide the movement of the rod extension.

The outer end of the rod extension 83 has a diameter adapted to project into the hollow or tubular contact shaft 40 and is provided with a locating collar 92 secured thereon by a suitable retaining ring. The extension 85 is pinned or otherwise secured to the inner end of the operating shaft 40 to rigidly and firmly interconnect the contact 28 for movement with the linkage 77 and the lever assembly 69, and additionally within the limited movement under the action of the contact closure loading spring 89.

The lever assembly is pivoted from the full line position, shown in FIG. 5, which extends the linkage 72 and the contact rod or shaft 40 to the full line collapsed position, as shown in FIG. 8, to open the contacts by the toggle mechanism 71, as follows.

The upper end of lever 77 terminates beneath the bracket 68 and is pivotally coupled to the toggle mechanism 71. A lateral spring pin 93 riveted or otherwise secured to the upper end of the arm 77 is most clearly shown in FIG. 8. The opening spring 76 is secured to such a pin 93 and extends forwardly therefrom with the opposite end coupled to the driving arm and pin assembly 70 by a common coupling pivot pin 94 projecting through related components thereof. As shown in FIG. 5, with the contact 28 in the closed position, the coil spring 76 is extended and establishes a spring loading on the lever arm 77 which is held in the loaded position by the toggle assembly 71.

The toggle assembly 71 includes a first toggle arm 95 in the form of similar, laterally spaced, plate-like members which are pivotally pinned to the opposite sides of the lever 77 as at 96. A second toggle arm 97 which is generally an elongated plate member is pivotally attached between the members 95 of the first arm by a connecting pin 98 and extends therefrom to the driving arm and pin assembly 70. The toggle members of the first arm 95 are interconnected by a stop pin 99 such as a roll pin secured within the appropriate openings. The stop pin 99 is located to engage the upper edge of the toggle arm and limit the relative pivotal movement to the expanded position of the elements in the closed position of the contacts and the toggle assembly 71 as shown in FIG. 5.

Figure 9:
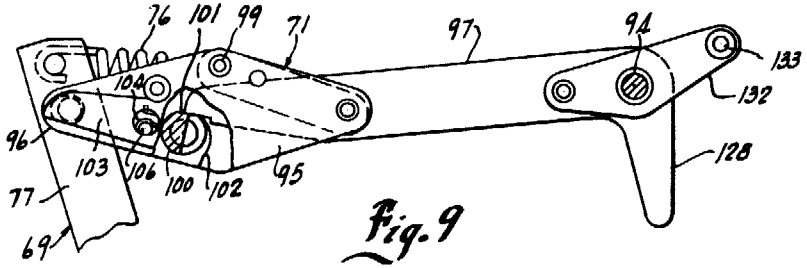
FIG. 9 is a fragmentary view more clearly showing the latch elements for the toggle arms.

A toggle latch element 100 is pivoted within the first toggle arm 95. The element 100 has a generally flat latch surface 101 aligned with the outer end of the second toggle arm 97, which is formed with a corresponding latching notch 102 on the outermost end. In the latched position, the arm 97 bears on the latch surface 101 tending to force the first arm 95 to pivot downwardly, as shown in FIG. 9. This would require further expansion of the coil spring 76 and the toggle assembly 71 is thus latched in place. The element 100 is secured to a trip arm 103 for positive rotation thereof which disengages the element from the second toggle arm 97 and allows the toggle arms 95 and 97 to collapse under the action of the coil spring 76.

Trip arm 103 is secured to the toggle latch element 100 and extends rearwardly to the one side of the first toggle arm 95. A small coil spring 104 encircles the trip element shaft with one end located within an elongated opening 105 in the trip lever and the opposite end looped over a reset pin 106 secured to the toggle arm 95. In the closed position, trip arm 103 is positioned for actuation by trip lever 73.

The trip lever 73 is pivotally mounted to the one side of the toggle bracket 68 with one end aligned with and coupled to the trip arm 103 and the opposite end aligned with and coupled to the electromagnetic tripper 74 and to the operating handle assembly 107. Lever 73 pivots freely in opposite directions on the pivot pin 108. A small extension spring 109*a* connected to the lever 73 and fixed pin within the assembly biases the lever 73 to a stand-by position. The forward end of the trip lever 73 includes a coupling pin 110 located within a vertically extended slot 111 in an L-shaped tripper bracket 112 of the tripper unit 74. The unit 74 may, for example, be a bistable electromagnetic device having an operating spring 113 located beneath the horizontal leg of bracket 112. Unit 74 includes a magnetic holding means to hold bracket 112 and spring 113 compressed. Upon receipt of a signal from pickup 10, the holding means is released and the spring forcibly moves the bracket 112 upwardly. The pin 110 is located at the lower end of the slot 111 in the bracket 112 in the stand-by position. When the tripper unit 74 is released, bracket 112 moves upwardly and positively pivots the trip arm 73 in a counterclockwise direction, as viewed in FIG. 5.

The pin and slot connection allows rotation of the trip lever 73 in response to operation of the handle 9 and manual operating assembly 107, as hereinafter described.

The opposite end of the trip lever 73 includes a release pin 109 secured to the side thereof and located in overlying relationship to the trip arm 103. Thus, when the lever 73 is pivoted counterclockwise, as in FIG. 5, the pin 109 moves downwardly, engages and positively rotates the trip arm 103 against the force of the preload spring 104, resulting in a positive rotation of the toggle latch element 101 which releases the toggle latch means and allows spring 76 to act and rapidly collapse the mechanism to move contact 28 to the open position. A tripper reset link 113 is pivotally secured to the center of lever arm 77 and projects forwardly therefrom. The outer end of the link 113 is slotted and pivotally coupled to a pin as at 114 on an L-shaped crank member 115. The common junction of the leg portions of member 115 is pivotally mounted on a fixed pivot shaft assembly 116 secured to the one side frame 65 to locate the crank generally overlying the one leg of the tripper bracket 112. An extension spring 117 is secured to the outer end of the upper crank arm and extends forwardly and downwardly to a fixed pin for trip lever spring 109*a*. The crank is continuously urged to rotate in a clockwise direction in FIG. 5, with the pin to the forward portion of the slot connection 114. When the assembly 69 is released and lever arm 77 pivots, as in FIG. 8, the crank 115 is released and rotates to engage bracket 112 and reset the tripper unit 74.

In accordance with a further aspect of this invention, a stop arm 118 is pivotally secured within the latch bracket 68 overlying the latch lever 77. The illustrated stop arm 118 is generally a U-shaped member pivotally mounted within bracket 68 on the interconnecting shaft unit 66. A spring anchor plate 119 is located centrally thereof on shaft 66. A pair of coil springs 120 to the opposite side of plate 119 encircles the shaft unit. The springs 120 have one end looped over the top edge of the latch stop arm 118 and plate 119 respectively and the opposite ends bearing on the underside of the bracket 68 to continuously urge the stop arm 118 to a rotated clockwise position. The one side of the stop arm 118 extends outwardly over the lever assembly 69 in alignment with the top edge of the latch arm 77 and includes a vertical stop notch 121 centrally thereof, with a reset camming surface 122 extending out therefrom over the toggle arm 95 and particularly stop pin 99. As the lever arm 77 pivots forwardly to the open contact position, the trailing edge moves forwardly of the stop notch 121 and the torsion springs 120 rapidly move the stop arm downwardly into stopping engagement, as shown in FIG. 8. The lever arm 77 is thus held in the clockwise pivoted position. This action positively prevents return movement of the lever assembly 69 and maintains a positive opening of the contacts and thereby essentially eliminating the danger of return bounce action of the assembly 69, linkage 72 and particularly the contact 28, which could, of course, result in undesirable arcing.

The stop arm 118 is mechanically released in response to manual resetting of the toggle arm 95. Thus, as arm 95 rotates from the collapsed position of FIG. 8, pin 99 engages arm surface 122 and positively lifts the stop arm to release arm 77 for subsequent pivoting to the reset position.

The forward end of the toggle mechanism 71 and particularly arm 97 is coupled to the drive arm and pin assembly 70 by the interconnecting pin 94.

Figure 6:
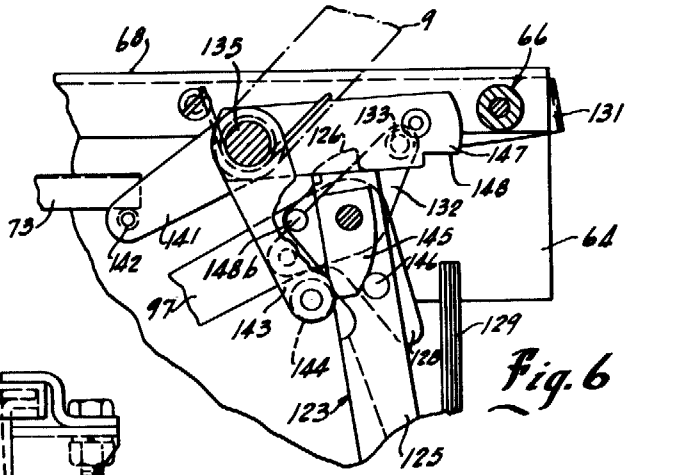
FIG. 6 is a fragmentary view of the operating handle mechanism and drive lever assembly taken generally on line 6—6 of FIG. 4 and illustrating a contact closing movement of the handle mechanism.
Figure 7:
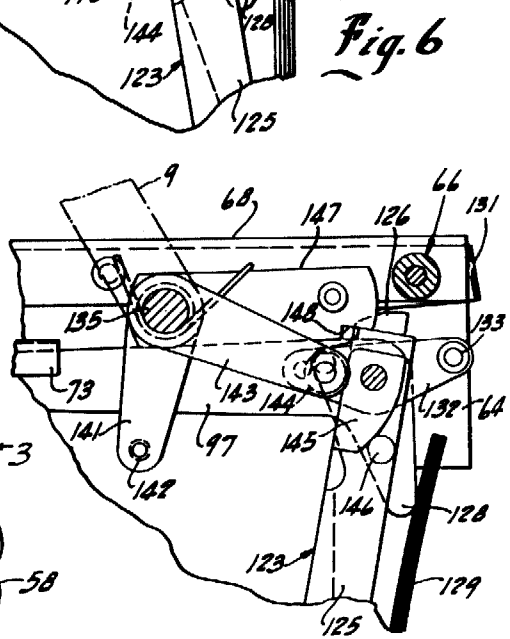
FIG. 7 is a view similar to FIG. 6 showing the assembly just prior to the automatic contact closing position.

The drive arm and pin assembly 70 includes a drive arm in the form of a U-shaped channel 123 opening forwardly, with the lower end thereof pivotally mounted on a fixed pivot shaft as at 124. The opposite side arms 125 and 126 of channel 123 project upwardly of the base portion 127 with the connecting pin 95 extending therethrough below bracket 68. The opening extension spring 76 is secured to pin 94 on the outer side of the arm 126. The toggle arm 97 is pivotally mounted on the pin 95 generally, centrally of the channel 123 between side arms 125 and 126 and includes a depending extension or leg portion 128 extending downwardly between the arms and into overlying relationship to the base 127 of the channel 123. A flat, leaf-spring 129 is secured extending upwardly in alignment with leg portion 128 in outwardly spaced relation. When channel 123 is reset from the collapsed position of FIG. 8, the leaf-spring 129 creates a reset force on the toggle assembly 71 and lever assembly 69, as shown in FIGS. 6 and 7.

The one side arm 126 of the U-shaped channel 123 projects upwardly from the coupling pin 94 into bracket 68 and is formed with an offset portion or notch 130 aligned with a stop notch in a stop arm 131 which is pivotally mounted on the forwad connecting shaft unit 66 within bracket 68. Stop arm 131 is similar to arm 118 and is spring biased toward arm 126 and notch 130. In the closed contact position of FIG. 5, stop arm 131 is released and mates with the notch 130 of the drive channel 126 to prevent movement of the corresponding end of the assembly and positively lock the assembly in the contact closed position. The stop arm 131 is positively released by collapse of the toggle assembly 71 which has a release plate 132 secured to arm 97 at pin 94. (FIGS. 7, 8) The plate 132 carries a release pin 133 aligned with the one side of the stop arm 131 and moves into releasing engagement in response to the final collapsing of the toggle assembly 71. The closing spring 75 is secured to pin 94 within the channel arms and extends rearwardly and downwardly to the one side of the toggle assembly with the lower end anchored on the stop shaft 79. The spring 75 thus urges the channel 123 to pivot counterclockwise in FIGS. 5 and 8 into engagement with a laterally extended stop shaft 134. In the collapsed toggle position, spring 75 is essentially unstressed. The spring 75 is stressed by pivoting of channel 123 clockwise in a contact closing operation of the handle operating assembly 107, as follows, and with reference particularly to FIGS. 5,6,7 and 11.

The drive arm and pin assembly 70 is coupled to the handle operating assembly 107 as a free-tripping coupling which permits coupling of the operating assembly 107 for manual opening and closing of the contact 28 without interfering with the automatic opening of the contact.

The handle operating assembly 107 includes an operating shaft 135 pivotally mounted in the side frames 64 and 65 and projecting to the opposite sides of the two frame plates. Handle 9 is pinned or otherwise suitably secured to the shaft 135 and movable between an open and closed position. A preloading arm 136 is secured to the one end of the shaft and a coil spring 137 is pinned to the arm 136 and to a spring plate 138. The spring is relaxed in the contact closed position and provides a spring loading of the handle which requires a positive force to move to the open position and thus prevents accidental partial or full movement thereof to the open position.

The shaft 135 extends through the sidewall of housing 54 with a liquid tight rotary seal 139. A plate 140 is secured to the shaft adjacent the handle 9 and includes mechanical stops to limit the stress on the handle. Plate 140 is also apertured as at **140*a* to permit locking of handle 9** in either open or closed position.

The operating handle assembly 107 includes a trip arm 141 secured to the shaft 135 to the one side of bracket 68 and extends rearwardly adjacent to the toggle trip lever 73. A trip pin 142 is secured to the outer end of the arm 141 and projects beneath the trip lever 73. The clockwise rotation of the arm 141, as viewed in FIG. 5, results in the lifting of the lever 73 to release the toggle mechanism 71 and cause the contact opening in the same manner as energization of the tripper unit 74.

A reset lever 143 is also secured to the shaft 135 with a common mounting hub **143*a* with arm 141. Reset lever 143 is angularly oriented with respect to the trip arm 141 and as shown most clearly in the end view of FIG. 6, projects downwardly adjacent the assembly 70 with handle 9 in the open position. A laterally extending force hub or pin 144 is generally aligned with a reset lever 145 pivotally secured to exterior of arm 125. A small stop pin 146 is located on the arm 125 behind lever 145**.

The counterclockwise rotation of the handle 9 moves the lever 143 into positive engagement with the lever 145 and transmits the force through pin 146 to pivot the drive arm and pin assembly about its pivot shaft 124 and pivoting it in a clockwise position, as viewed in FIG. 6. The pivoting movement causes the depending leg portion 128 of the toggle arm 97 to engage the upstanding leaf-spring 129 which tends to rotate arm 97 to reset the toggle. The lever arm 77 is held against movement by stop 118 and the pivoting of channel 123 therefore results in outward deflection of the spring 129 and loading of the toggle arm. As the channel continues to rotate the pin 94 moves and the toggle arms 95 and 97 expand and move toward the reset position, which is completed slightly before complete movement of the handle to the closed position. Thus, the stop pin 99 of toggle arm 95 engages the cam end 122 of stop arm 118 and moves arm 118 upwardly to release lever arm 77 of assembly 69.

The pivotal movement of the channel 123 also stresses the closing spring 75 as well as the opening spring 76.

A redundant safety latch plate 147 is secured to the side of the top U-shaped latch bracket 68 on the handle shaft 135 and overlies the side arm 125. As the arm assembly 70 pivots in a clockwise direction, the arm 125 moves into alignment with a latch notch 148 of plate 147 which pivots downwardly behind arm 125 and prevents return movement. A small coil spring **148*a* encircles the shafts 135 between the plate 147 and a stop pin. The latch plate 147** produces a secondary interlock which is established at approximately the same time as the toggle elements react and preferably slightly thereafter. The latch prevents any possibility of the handle mechanism being snapped back by the now loaded springs if the operator releases the handle force before the toggle is engaged.

The continued rotation of the handle reset lever 143 moves the force pin 144 upwardly on lever 145 toward the pivot axis of such lever, as shown in FIG. 7. The further movement causes the force pin 144 to actually move past such pivot axis and the force is now applied above the pivot axis which causes the reset lever 145 to rotate, in a clockwise direction, in the drawing, and the pin 144 moves above the lever. The lever 145 in pivoting engages a stop pin **148*b* on arm 125 to prevent complete snap over and failure to return to the depending position. The assembly 70 is now released from the operating handle mechanism 107 but is held by the latch plate 147 engagement with the arm 125. Further, rotation of the handle 9 to the closing position, and attached lever 143 moves the pin 144 of lever 143 into release engagement with a pin 149 on plate 147 which is pivoted upwardly from and releases channel 123. The closing spring 75 which was stressed by pivoting of channel 123 now acts to positively pivot assemblies 69 and 70 in the counterclockwise direction to rapidly, positively close the contacts 28**.

In operation, the handle 9 and lever 143 must be positively actuated during which movement, the opening spring 76 and the closing spring 75 are stressed by the single movement and eventually the closing linkage is released such that, as the lever moves to the end of its stroke, spring-driven closing of the interrupter 3 is created. In this position, the handle operating mechanism is released from the mechanism which is free to respond to an electrical trip signal.

The linkage provides a trip free mechanism in which the handle operating mechanism 107 does not move when the toggle assembly 71 is tripped by the tripper unit 74. In the contact closed position of the handle 9, the lever 143 is pivoted upwardly and the pin 144 is to the opposite or backside of the pivot lever 145. If the tripper unit 74 actuates the toggle mechanism the handle operating mechanism 107 remains in such position. To again close the interrupter contacts, the handle and lever 143 must be reset from the closed position to the open position to again pick-up the lever 145 and then return to the closed position to sequentially effect the pivoting of assembly 70 and complete closure of the contact 28 under the action of spring 75. This also again stresses and loads the contact opening spring 76.

In summary, the operating mechanism provides a quick close-quick open operating mechanism with energy for the proposed function stored in a pair of extension springs in response to the manual closing of the contacts 27–28. Once closed the apparatus can be opened, electrically or manually. In either position, the quick open spring 76 and toggle mechanism 71 operates to provide a rapid and positive movement of contact 28, with the stop arm 118 engaged with lever 77 to positively prevent contact bounce.

Although the apparatus is shown in applying a low volt energy tripper device, any other suitable device can be employed. For example, a high voltage series coil with a hydraulic time delay mechanism can be coupled directly to the linkage to effect tripping thereof.

The multiple lever and drive arm assemblies with the interconnected toggle assembly and separate yieldable means for opening and closing has been found to provide a highly reliable and positive acting contact positioning mechanism, particularly adapted to operation of a vacuum interrupter. The encapsulated interrupter sealed to the submersible housing of the operating mechanism provides an unusually practical construction. The switch device is readily adapted to underground installation while permitting ready access to the operating mechanism when required. Replacement of the separate interrupters may, of course, be readily and conveniently made to the same operating mechanism. The separate vacuum enclosed interrupter with the solid insulation is also adapted to mounting with a plurality of other interrupters in a compact assembly as a relatively thin wall provides the necessary physical strength and also the electrical insulation equivalent to large air spacing and oil depths. Thus, a five-eights thick wall as previously described will provide the equivalent of seven inches of air.

The present invention has been illustrated with the single embodiment which clearly discloses the various features and advantages of the invention. The particulars of the encapsulated interrupter and of the toggle mechanism may, of course, be varied within the teaching of this invention and the best mode of carrying out the invention is shown by the illustrated embodiment.

Various modes of carrying out the invention are contemplated as being within the scope of the following claims, particularly pointing out and distinctly claiming the subject matter which is regarded as the invention.

We claim:

1. A protective switch assembly for rapidly moving a movable contact relative to a second contact, said movable contact having a contact coupling element, comprising a support means, a pair of lever assemblies having spaced pivotal mounting means connected to the support means, one of said lever assemblies having a connector means adapted to be connected to the coupling element, a toggle means connecting said lever assemblies and including a releasable latch means permitting collapse of the toggle means, a first yieldable force member coupled to the toggle means and to the lever assemblies and biasing the assemblies toward each other to forcibly move the movable contact relative to the fixed contact in response to release of said latch means, trip means coupled to release said latch means, a second yieldable force member connected to said support means and coupled to the assemblies and toggle means, and an operator means connected to move said second force member and operable in response to partial movement thereof to reset the latch means and having means to release said second yieldable means and positively move the lever assemblies and the toggle means and thereby forcibly oppositely move the movable contact relative to the fixed contact.

2. The switch assembly of claim 1 and said support means including a submersible housing enclosing said lever assemblies and said toggle means, and said housing having a contact coupling opening and said contact coupling element passing through said opening.

3. The switch assembly of claim 1 including a trip-free manual operating lever having a means movable to engage the trip means for release of said latch means, and said operator means including a reset lever means movable to a reset position and engaging and moving the tripped lever assembly toward the reset position and stressing the second yieldable means and after a selected portion of movement of the reset lever means to the reset position releasing the toggle means and the second yieldable means to provide quick moving of the movable contact.

4. The switch assembly of claim 3 wherein said reset lever assembly includes a pivoted reset lever in the path of the reset lever means and a stop to prevent pivoting of the reset lever in the reset lever direction of the reset means and freely pivoted in the opposite direction.

5. A toggle switch assembly for rapid opening and closing of a pair of contacts, comprising a support means, a toggle mechanism mounted on said support means and having a latch means and movable between an expanded latched position and a collapsed position, lever arm assembly coupling the toggle mechanism to one of contacts, a drive arm assembly connected to said toggle mechanism to reset said toggle mechanism said toggle mechanism holding the contacts closed in the latched position and the contacts open in the collapsed position, an opening spring means coupled to the toggle mechanism and operable to move the toggle mechanism to the collapsed position and to move the lever arm assembly and collapsed toggle mechanism to a predetermined position to open said contacts, a closing spring means having a fixed support secured to said support means and to said drive arm asembly, and said drive arm assembly having an operating member connected to the closing spring and to the toggle mechanism and movable to move the collapsed toggle mechaism in said predetermined position toward the latch position and thereafter movable from the toggle mechanism to release the toggle mechanism for resetting in the expanded latched position by the closing spring means.

6. In the toggle switch assembly of claim 5 said drive arm assembly mounted in spaced aligned relation to the lever arm assembly, said toggle mechanism including a pair of pivotally connected toggle elements, a stop means releasably engaging the lever arm assembly in the collapsed position of the toggle mechanism to positively hold the contacts open, and said operating member movable to a contact closing position and including a lever engageable with the drive arm assembly to forcibly move the drive arm assembly to an expanded position with said lever arm assembly in the locked open position and to load the closing spring and thereafter releasing the lever arm and drive arm assemblies prior to reaching said closing position for positive closing of the contacts.

7. In the toggle switch assembly of claim 6 including a linkage means coupling said lever arm assembly to the movable contact, said linkage means including a first link fixed, to said lever arm assembly, a spring loaded sleeve having a contact shaft extension slidably mounted therein, a second link pivotally coupled at one end to said first link and at the opposite end to said sleeve and shaft extension, said shaft extension having a limited lost motion connection to said second link, and a contact loading spring in said sleeve and coupled to load the shaft extension in the contact closing position of said switch assembly.

8. The toggle switch assembly of claim 7 wherein one of said toggle elements being pivotally connected to the lever arm assembly and the other of said toggle elements being pivotally connected to the other drive arm assembly, said opening spring means being an extension spring secured at opposite ends to the lever arm assembly and the drive arm assembly said toggle elements including releasably engageable latch portions defining the latch means and latching the toggle elements in an expanded position and holding the lever and drive arm assemblies in spaced relation with the spring means extended, a stop means in the spring-loaded path of the drive arm assembly, said latch means including release means operable to allow the toggle elements to collapse and permit said lever arm assembly to pivot, a fixed stop secured to said support means, said closing spring means being an extension spring secured at the opposite ends to the drive arm assembly and to a fixed stop, said closing spring means being stressed by pivoting of said drive arm assembly from said stop means and operable to actuate said toggle mechanism and said lever arm assembly to the expanded position to rapidly close said contacts, a manual operating member having a releasable coupling means connected to move the drive arm assembly and operable to stress said first and second spring means and said releasable coupling means disengaging said drive arm assembly for release of and positive positioning of said lever arm assembly and the toggle mechanism.

9. In a protective switch assembly having means for opening and closing movement of a movable contact relative to fixed contact, comprising a housing, a toggle mechanism disposed in said housing and including a lever arm assembly pivotally mounted in the housing and a drive arm assembly pivotally mounted in spaced aligned relation to the lever arm assembly, said lever arm assembly having means for connection to said movable contact for moving said movable contact in response to pivoting of said lever arm assembly said toggle mechanism including a pair of pivotally connected toggle elements, a first of the toggle elements pivotally connected to the lever arm assembly, and the second of the toggle elements pivotally connected to the drive arm assembly, said toggle elements including a releasable latch means holding the toggle elements in an aligned expanded position, an opening coil spring secured at the opposite ends to said lever arm assembly and said drive arm assembly and loaded with the toggle elements in the expanded position, stop means limiting the pivotal movement of the lever arm assembly and of the drive arm assembly, trip means to release said latch means and thereby said opening coil spring, said opening spring being operable to rapidly move the movable contact from engagement with the fixed contact in response to release of said latch means, a fixed stop secured to the housing, a closing coil spring connected at opposite ends to the drive arm assembly and said fixed stop and loaded with the toggle elements in the expanded position, an operating member movable to a contact closing position and including a closing lever engageable with the drive arm assembly to forcibly move the drive arm assembly to an expanded position to reset the toggle elements of the latch means and to load the closing spring and having means to disengage the closing lever from the drive arm assembly and thereby releasing the drive arm assembly immediately prior to reaching said closing position, and said closing spring means being operable to rapidly move said lever arm assembly and thereby move movable contact into engagement with the fixed contact in response to release of said drive arm assembly.

10. The switch device of claim 9 wherein said lever arm assembly includes a lever arm having an intermediate pivot means, the one end of the lever arm being pivotally pinned to one of said toggle element, said opening spring being secured to said lever arm outwardly of said one of said toggle elements, said stop means includes a first stop located in the path of the opposite end of the lever arm, a coupling lever connected to the lever arm to one side of the toggle mechanism, a sleeve having an operating rod extension slidably mounted in said sleeve, a pivot arm pivotal attached to the sleeve and rod extension, said rod extension having a limited lost motion attachment to said arm, a contact loading spring in said sleeve and urging the rod extension outwardly, coupling link connecting said sleeve to said coupling lever for positioning of said sleeve.

11. The switch device of claim 10 including a latch arm mounted to engage the lever arm in the collapsed position of the toggle assembly and prevent rebound of the lever arm assembly and linkage to maintain the contacts open.

12. The switch assembly of claim 9 including a manual operating handle assembly including a rotating shaft having a handle secured to the shaft, said shaft having a latch plate, a spring-loaded arm secured to the shaft to load the handle, said shaft including a pair of angularly offset levers, one of said levers engageable with the trip arm to trip said latch means and the second lever engageable with the drive arm assembly for a predetermined initial resetting and then disengageable to release the drive arm assembly.

13. The switch assembly of claim 9 wherein said drive arm assembly includes a drive arm pivotally mounted at one end, said opening coil and said closing coil being secured to the free end of said arm, a latch means pivotally mounted to engage said arm, said second toggle element including a depending reset arm abutting the outer side of said arm and positively pivoted in response to reset movement of said drive arm, and a reset spring located in the path of the depending reset arm to load the toggle element and reset said latch means.

14. The switch assembly of claim 13, wherein a reset lever is secured to the drive arm and constructed to transmit the force on the lever to the arm in one direction and freely movable in the opposite direction, an operating handle assembly, mounting means connected to said handle assembly, said handle assembly having a reset means aligned with the reset lever for engaging thereof and moving past said reset lever upon selected reset of the drive arm, a latch means mounted to move into latching engagement with the drive arm as the reset means disengages said drive arm, said latch means being engaged by further movement of said handle assembly to release said drive arm and toggle assembly.

15. The switch assembly of claim 14 wherein said drive arm assembly includes a generally U-shaped arm pivotally mounted at one end and having a pair of parallel sides, said opening coil and said closing coil being secured to the free end of said arm, said one side having a notch, a latch arm pivotally mounted to engage said notch, said second toggle element including a depending arm abutting the outer base of the U-shaped arm and positively pivoted in response to reset movement of drive arm assembly, a reset spring located in the path of the depending reset lever to load the toggle element and reset said latch means, a depending reset lever pivotally secured to the second side of the U-shaped arm, a stop pin behind the lever to transmit the force on the lever to the arm, an operating handle assembly, a pivotal mounting means connected to said handle assembly, said handle assembly having a reset pin aligned with the outer end of the reset lever for transmitting of the rotation to arm, the aixs of the handle assembly being offset from the reset lever and moving said reset pin outwardly of the arm upon selected reset of the U-shaped arm, a latch lever mounted to move into latching engagement with the arm as the reset pin disengages said trip lever and then engaged by said handle assembly to release said U-shaped arm and toggle assembly.

16. The switch device of claim 15 wherein said lever arm assembly includes a lever arm having an intermediate pivot means, the one end of the lever arm being pivotally pinned to one of said toggle elements, said opening spring being secured to said lever arm outwardly of the toggle element, a stop located in the path of opposite end of the lever arm, a coupling lever connected to the lever arm to one side of the toggle mechanism, a sleeve having an operating rod extension slidably mounted in said sleeve, a pivot arm pivotally attached to the sleeve and rod extension, said rod extension having a limited lost motion attachment to said arm, a contact loading spring in said sleeve and urging the rod extension outwardly, a coupling link connecting said sleeve to said coupling lever for positioning of said sleeve.

17. The switch device of claim 16 including a latch arm mounted to engage the lever arm in the collapsed position of the toggle assembly and preventing rebound of the lever arm assembly and linkage to maintain the contacts open.

* * * * *